United States Patent [19]

Papis

[11] 4,438,809

[45] Mar. 27, 1984

[54] TAPERED PLATE ANNULAR HEAT EXCHANGER

[76] Inventor: Thaddeus Papis, 10115 Victoria Ave., Riverside, Calif. 92503

[21] Appl. No.: 174,362

[22] Filed: Aug. 1, 1980

[51] Int. Cl.[3] ..... F28F 3/08

[52] U.S. Cl. ..... 165/166; 60/39.512

[58] Field of Search ..... 60/39.51; 165/166, 167, 165/146, 147

[56] References Cited

U.S. PATENT DOCUMENTS

| | | | |
|---|---|---|---|
| 1,662,870 | 3/1928 | Stancliffe | 165/166 |
| 2,650,073 | 8/1953 | Huhn | 60/39.51 R |
| 3,507,115 | 4/1970 | Wosika | 60/39.51 R |

*Primary Examiner*—William R. Cline
*Assistant Examiner*—Theophil W. Streule

[57] ABSTRACT

A heavy duty heat exchanger consisting of a large number of plates of tapered cross-section, selectively provided with essentially lengthwise parallel grooves and land areas at the lengthwise edges. Upon being stacked together and joined, the plates form an inherently leak-tight, rugged and compact heat transfer core with axially directed fluid passages and integral with it two fluid transition zones, all of radially symmetrical, annular cross-section, throughout. Very large fluid flow rates can be accommodated and very high heat transfer effectiveness attained without increased design complexity or cost escalation.

6 Claims, 11 Drawing Figures

27

TAPERED PLATE ANNULAR HEAT EXCHANGER

BACKGROUND OF THE INVENTION

1. Field of the Invention

This invention relates to heat transfer apparatus and, more specifically, to counterflow and parallel heat exchangers for heavy duty service, i.e., high pressure, or high pressure and high temperature applications with high fluid flow rates, especially in large utility power conversion systems operating on closed thermodynamic cycles and in some petrochemical installations and refineries, where the highest degree of heat recovery efficiently attainable is a prime consideration and the fluids are reasonably clean.

2. Description of the Prior Art

Heavy duty heat exchangers are almost always of shell-and-tube type because round tubes can accommodate very high fluid pressures and large thermal gradients. In flat plate and corrugated sheet heat exchanger matrices that capability is low and, therefore, they are not suitable for heavy duty application.

Shell-and-tube heat exchangers, however, commonly present many difficult problems in detail design; for example, provision for tube heaters. In service they frequently suffer significant performance degradation due to leakages at the tube to tubesheet joints and distortions of tube spacing resulting from thermal gradients and differential expansion between the tubes and the shell. They are frequently subject to severe vibration problems which may impose serious constraints upon their design. Their maintenance is costly due to the presence of many welds, which constitute the zones of stress concentration and are often susceptible to corrosion. These problems are particularly common and serious in high temperatures and high pressure applications in which differential thermal expansions are large, and tubes must be attached and sealed at the tubesheet by welding to achieve a high degree of leaktightness.

In applications with large fluid flow rates tubular heat exchangers are inherently bulky, complex and costly. Essentially, this is so because construction of counterflow tubular heat exchangers does not permit simultaneous employment of small diameter tubes and large fluid flow frontal areas. Tubes of small diameters are very difficult to install in thick tubesheets consistent with large fluid flow frontal areas. Furthermore, reductions in tube size must be accompanied by rapid increases in a number of tubes in order to maintain the required fluid flow rate, and by a decrease in tube spacing in order to maintain the proper balance between the thermal resistances on the tube side and the shell side of the heat exchanger. Thus, very soon, increases in the number of tubes becomes prohibitively costly both on account of manufacturing and material costs, since tube stock is relatively expensive. Furthermore, decrease in tube spacing soon becomes altogether impossible, since there is a limit upon the number of holes that can be drilled in a given tubesheet without the latter being critically weakened. For these reasons, even in the absence of corrosion and fouling, as in the case of clean fluids, relatively large tube sizes are necessary. As it is well known to those skilled in the art, increases in tube diameters require even greater proportional increases in tube length, if the required heat transfer effectiveness of the equipment is to be maintained. These, in turn, increase material costs, heat transfer losses, differential thermal expansion, and structural problems beyond tolerable limits.

Prior art includes many detail solutions aimed at alleviating the inherent disadvantages of shell-and-tube counterflow heat exchangers. For example, one ingenuous approach to the lack of space at both ends of shell-and-tube type heat exchanger is to group the tubes into bundles with large number of small headers. This arrangem:ent, originally worked out by Esher-Wyss, has been subsequently used quite commonly, although with some modifications, by others, e.g., Donald W. Culvert, U.S. Pat. No. 4,098,329. However, all such schemes do not solve the fundamental problem posed by the inability to provide small fluid passages in large, heavy duty heat exchangers; they merely alleviate it with some significant, yet limited degrees of success. It is largely for this reason that in many large installations, instead of one heat exchanger several smaller units working in parallel are frequently employed.

Another consideration that may limit the frontal area of a heavy duty shell-and-tube type heat exchanger is the wall thickness of the shell, particularly when the pressure of the shell side fluid is also high. The required wall thickness of cylindrical shell being proportional to its diameter, increasing shell diameter soon leads to excessive material costs, design difficulties, logistic problems and, possibly, potential safety hazards.

In some installations, such as shipboard power plants, restriction upon equipment length may dictate the use of tubes of the smallest size possible. In such cases, manufacturing costs grow rapidly, while excessive installation intricacies tend to degrade the system's reliability and performance. The ultimate effect of the four-way compromise which must be made between size, complexity, effectiveness and performance of the heavy duty heat exchange equipment is that the overall plant efficiency is significantly compromised, while its initial and operating costs attributable to the characteristics of shell-and-tube design still remain high.

Flat plate-fin and corrugated plate heat exchangers are very common in a great variety of forms. They can be both economical and highly satisfactory in some applications, albeit they also commonly experience difficult problems due to thermal gradients and susceptibility to vibrations. Quite often they are of annular cross-section as it is exemplified by the U.S. Pat. No. 3,228,464 to W. J. Stein et al, U.S. Pat. No. 3,741,293 to R. J. Haberski, U.S. Pat. No. 4,098,330 to R. J. Flower and others, this geometrical form being particularly well adaptable to aircraft gas turbines, which operate on open cycles, recover heat from exhaust gases and, therefore, require low pressure regenerators only. Torroidal heat exchanger disclosed in U.S. Pat. No. 3,255,818 to P. E. Beam, Jr., et al, may be of special interest in that it uses involute plate. U.S. Pat. Nos. 3,495,434 and 4,049,051 and 4,073,340 to K. O. Parker cover a gas turbine heat exchanger of the formed plate, counterflow type.

However, none of the prior art makes use of tapered plate as a structural or heat transfer element. Their assembly generally is an elaborate process. Furthermore, the common characteristic of all the aforementioned and other prior art plate heat exchangers is that their usefulness is limited to low pressure and low temperature systems or moderate pressure and temperature systems such that can tolerate certain amount of leakage between the hot and cold fluids. None of prior art plate heat exchangers qualifies nor is claimed to qualify for heavy duty, i.e., high temperature and/or pressure service such as is encountered, e.g., in some large utility power plants, gas cooled reactors, large petrochemical installations and some refineries.

SUMMARY OF THE INVENTION

It is apparent from the aforegoing discussion that the primary object of the present invention is to provide an efficient and economical, high performance heavy duty heat exchanger, capable of accommodating high fluid mass flow rates at high pressures, or high pressures and high temperatures, yet free from the drawbacks and shortcomings of the shell-and-tube type heat exchangers (some of said shortcomings being shared by flat plate and corrugated sheet heat exchanger designs which, moreover, are altogether unfit for heavy duty service).

This many-pronged objective is attained in the present invention mainly through the introduction and proper utilization of multiplicity of tapered plates as basic structural elements and by provision in said plates of multiplicity of parallel and essentially lengthwise grooves of small cross-section and rather thick walls for fluid passages, while leaving land areas at plate edges for plate joining and sealing the joints against leakage. The relatively thick groove walls thus formed become heat transfer fins and tapered plate supports in the annular selfclosed assembly.

In the preferred embodiment of the invention, presented as a counterflow heat exchanger for two fluids, there are two distinct types of plates only. Upon juxtaposing said plates alternately and joining them together, a heat transfer core of plate-fin variety and of parallel or counterflow configuration, and two integral with it fluid transition zones are formed, all of radially symmetrical annular cross-section. The resultant very rugged and stiff self-enclosed structure with outstanding pressure vessel capacity is fully suitable for heavy duty applications and virtually immune to flow induced mechanical vibrations. The heat exchanger thus constructed is inherently leakproof and altogether free from tube related problems.

The grooves can be produced in plates by chemical milling, machining, electrodeposition or other means that may be considered to be most desirable on the grounds of expediency or economy in a given situation. The width and the depth of each successive groove across the plate may be varied so as to assure that the resultant fluid passages have hydraulic diameters which are not only small but also reasonably constant for each fluid. Very small fluid passages can be produced in large quantities consistent with large fluid flow rates without manufacturing costs escalation or other adverse effects such as excessive radial thermal gradients or differential expansion. It follows, therefore, that heat exchangers designed and constructed in accordance with the present invention can have very large fluid flow rates and, at the same time, be very short. It further follows that they can be designed and built for greater heat transfer effectiveness and higher performance than prior art heavy duty heat exchangers.

Diffusion bonding, brazing and welding are among the means available for plate joining, depending upon specific circumstances of a given application.

Alternate embodiments of the present invention include, among others, parallel flow heat exchangers, heat exchangers of more than two fluids, and heat exchangers with alternate plate-groove designs and combinations.

Further objects and advantages of the present invention will become apparent from consideration of the drawings and ensuing description thereof.

DESCRIPTION OF THE PREFERRED EMBODIMENT

Many distinctly different embodiments of the present invention are possible, each of which may be considered to constitute the preferred embodiment in a specific application. Furthermore, even in a given application alternative embodiments with some mutually exclusive, important features of fully comparative merit are possible. However, all heat exchangers designed and built in accordance with the present invention will have it in common that their basic elements are tapered plates selectively provided with grooves which in the assembled unit become fluid passages with walls serving both as heat transfer fins and prime load carriers.

In the present disclosure the invention will be described in detail with reference to a simple counterflow heat exchanger in which cold H.P. fluid extracts heat from hot L.P. fluid. To facilitate the presentation further the heat exchanger is specified as a recuperator for a large closed cycle power conversion system. This implies that H.P. fluid and L.P. fluid are actually a H.P. stream and a L.P. stream of the same fluid, the working medium of the cycle. Against the background provided by such an embodiment, which for the present purposes may be referred to as the preferred embodiment, the most fundamental aspects of the invention will be presented. Next, some modifications and alternate embodiments will be brought forth, partly in order to amplify the presentation and partly in order to indicate and to illustrate the potential of the invention in the hands of those skilled in the art.

Since, as it will be seen, the design of heat transfer equipment in accordance with the present invention is strictly controlled by the design of the plates, it is both logical and convenient to begin the description of the preferred embodiment recuperator with a description of the plates.

In the operation of said recuperator two basic fluid streams are involved and, therefore, two distinct types of the plates are necessary. Since grooves in one type of plate will carry L.P. fluid only, whereas grooves in the other will carry H.P. fluid, said two distinct plates will be referred to as L.P. plate and H.P. plate, respectively.

Figure 1:
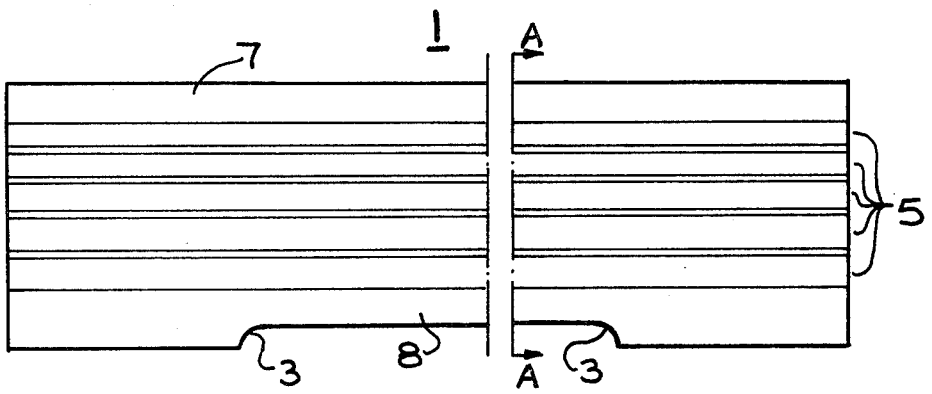
FIG. 1 is a plan view of one particular kind of a L.P. (Low Pressure) type of plate in accordance with the present invention.
Figure 3:
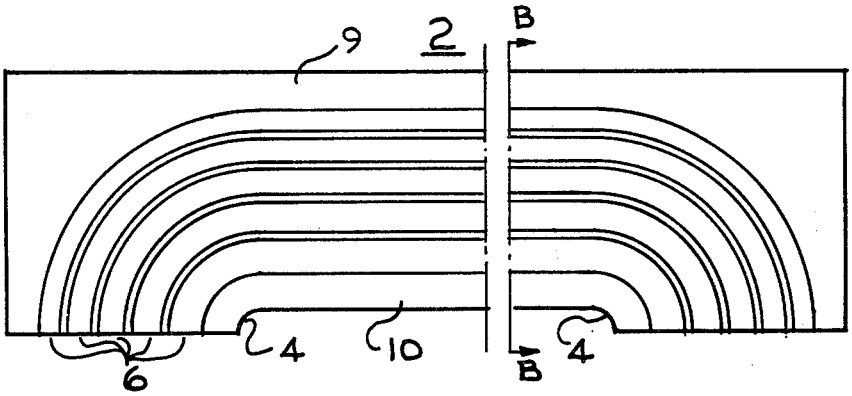
FIG. 3 is a plan view of one particular kind of a H.P. (High Pressure) type of plate in accordance with the present invention.
Figure 2:
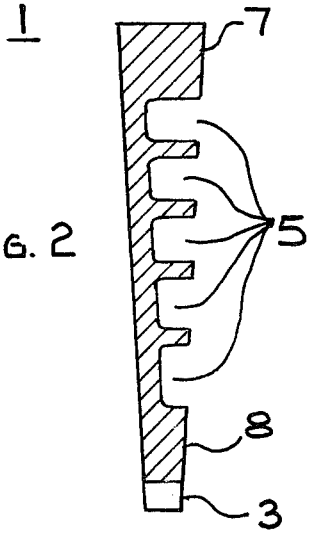
FIG. 2 is a cross-sectional view of the L.P. plate of FIG. 1 taken along the section A—A and viewing in the direction of arrows in FIG. 1.
Figure 4:
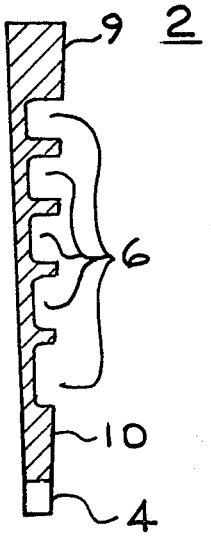
FIG. 4 is a cross-sectional view of the H.P. plate of FIG. 2 taken along the section B—B and viewing in the direction of arrows in FIG. 2.

With reference to FIGS. 1 and 2 showing the L.P. plate 1, and FIGS. 3 and 4 showing the H.P. plate 2 it is noted that the plan view countours of the two plates are identical and of a regular geometrical form resembling a rather thick and very shallow letter U (shown inverted on the drawings) with wide base, sharp external corners and very short "truncated" arms. The latter are designated on the drawings with the numeral 3 in the case of L.P. plate and the numeral 4 in the case of H.P. plate. The object of these arms is to facilitate provision and attachment of external manifolding for the assembled heat exchanger.

With regard to tapered cross-sections of L.P. and H.P. plates, shown on FIGS. 2 and 4 respectively, it is noted that neglecting the presence of the grooves 5 in the L.P. plate and grooves 6 in the H.P. plate, said cross-sections are in the form of small angle sectors of an annulus which is common to both plates.

The sector angle of the L.P. plate cross-section, shown in FIG. 2, is greater than that of the H.P. plate cross-section, shown in FIG. 4, resulting in L.P. plate being thicker than H.P. plate and permitting provision of deeper grooves and larger flow areas for the L.P. fluid than those of H.P. fluid, which circumstance is often deemed to be desirable from the standpoint of the overall power plant performance. In this connection, however, it should be clearly understood that, if need be, H.P. plate can be made to be the thicker of the two and to have the greater fluid flow area; or else the two plates may be made to be identical in that respect.

The fundamental difference between the L.P. and H.P. plates is that the grooves 5 in L.P. plate run in straight parallel lines throughout the full plate length from one end to the other (see FIG. 1), whereas the grooves 6 in the H.P. plate curve at both plate ends in the direction of decreasing plate thickness (see FIG. 3).

Both plates are provided at their edges with land areas, designated with numerals 7 and 8 in L.P. plate, and 9 and 10 in H.P. plate.

In both plates as plate thickness diminishes due to the taper the grooves necessarily become shallower. To prevent excessive reduction in fluid passage areas and in hydraulic diameters this reduction in grooves depth is compensated by increases in their width. Again, however, it should be clearly understood that there may be no need for equal flow areas or equal hydraulic diameters for each passage. The primary object herein is to show that this can be done, if desired.

In the interest of clarity, the plates shown in the drawings have a few grooves only and are relatively very thick. Actually, in a typical large heat exchanger designed in accordance with the present invention, including the instant recuperator, the plate will have a large number of grooves and will be sufficiently thin as to allow the number of plates per unit to run into the high hundreds or more.

In principle, the grooves in the plate can be produced by any means whatsoever, including such diverse methods as machining, forming, and electrodeposition. Chemical milling, however, offers a particularly attractive economical method for the production of large numbers of small grooves in rather large but thin plates. Furthermore, the application of this process is naturally well suited for the present needs because shallow grooves with rounded corners, produced by chemical milling, are highly desirable from the standpoint of heat transfer and, also, on structural grounds.

Figure 5:
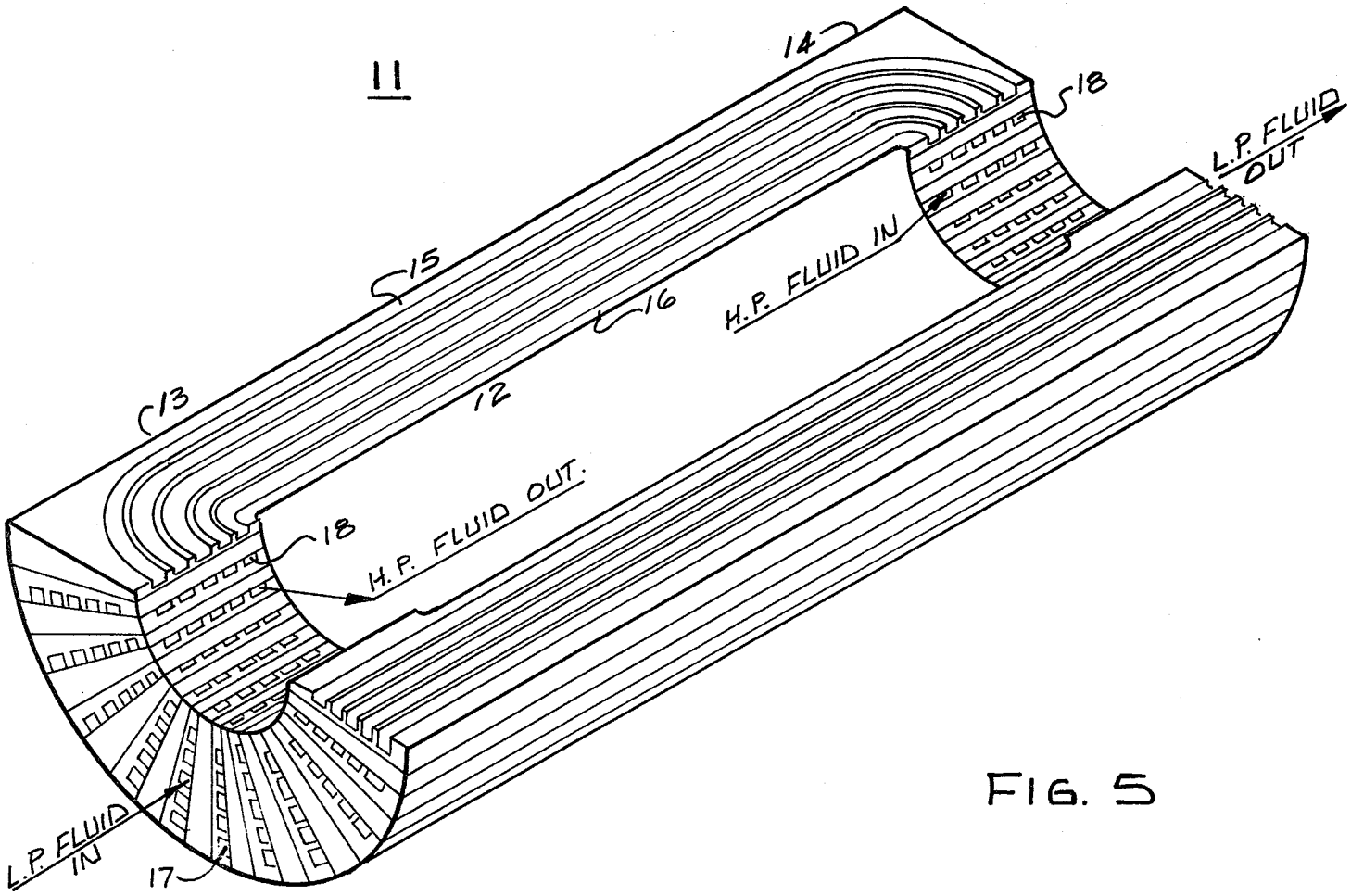
FIG. 5 is a perspective view, with top half of the apparatus cut off and manifolding removed, upon one embodiment of the present invention also referred to as preferred embodiment.

Upon stacking alternately the L.P. and H.P. plates, back to face, a self-enclosed heat exchanger 11 is formed, complete although without external manifolds, as shown in perspective view with top half removed in FIG. 5. It is of radially symmetrical annular cross-section throughout and comprises the heat transfer core 12 and two fluid transition zones 13 and 14. The plates are joined together at their interfaces by diffusion bonding, brazing, or other methods; thus land areas 7 and 9 become the outer enclosure 15 of the apparatus, whereas land areas 8 and 10 similarly become the inner enclosure 16. The grooves 5 of plate 1 closed by the back face of plate 2 now become L.P. fluid passages 17, and similarly the grooves 6 of plate 2, closed by the back face of plate 1, form the H.P. fluid passages 18. The groove walls now become the fins from the standpoint of heat transfer and the load carrying members structurally. The plate webs become the primary heat transfer surfaces. As it can be seen in FIG. 6, the L.P. and H.P. passages are in an "in line" relationship, said passages alternating along common concentric circles. A comprehensive side elevation view of the heat exchanger including manifolds and nozzles, with front top quarter-segment removed for better illustration, is presented in FIG. 7.

Figure 6:
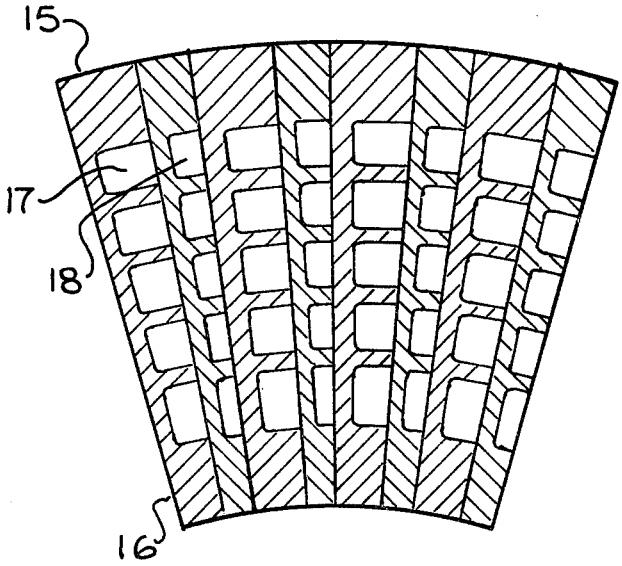
FIG. 6 is a cross-sectional view of the heat transfer core of the heat exchanger of FIG. 5.
Figure 7:
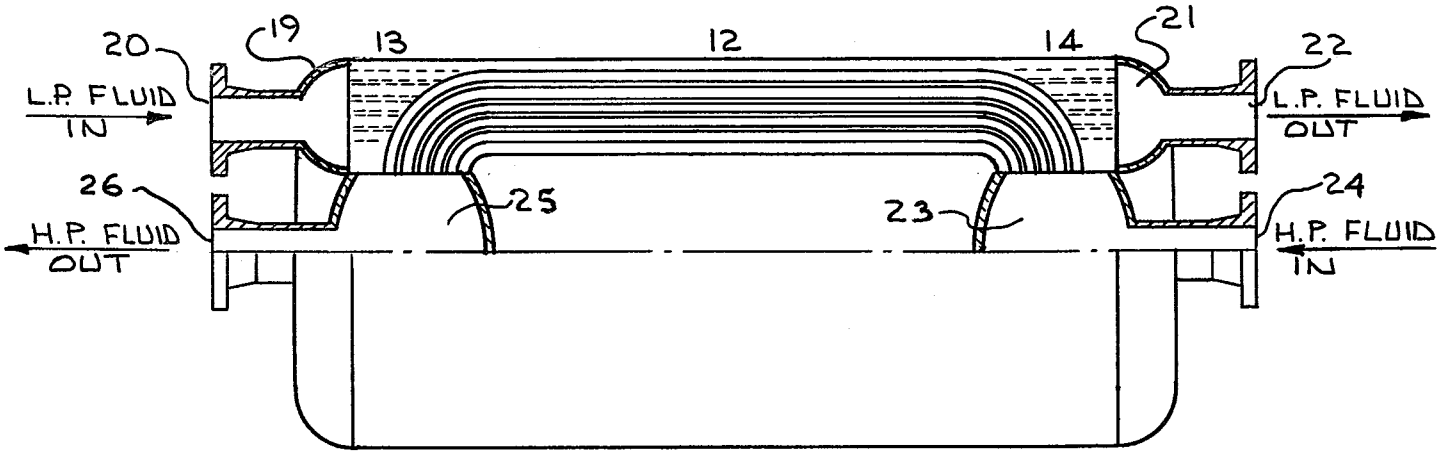
FIG. 7 is a comprehensive side elevation view, with a cut out, of the preferred embodiment including manifolding and nozzles.

In operation, referring to FIGS. 5 and 7, the hot L.P. fluid enters the passages 17 at the front face of heat exchanger from the L.P. fluid entry manifold 19, entered earlier via nozzle 20; after traversing full length of the heat exchanger in straight lines it exits at the opposite face into the L.P. fluid exit manifold 21, and thence is discharged through the exit nozzle 22. The configuration of the recuperator being counterflow, the cold H.P. fluid enters the radially oriented passages 18 at the back end of the recuperator from the H.P. fluid entry manifold 23, entered earlier via nozzle 24. Its initially outwardly radial flow changes over the transition zone 14 to pure axial counterflow in the heat transfer core 12, where it remains in a close heat transfer relationship with the L.P. fluid, as it is shown on FIG. 6. Again referring to FIGS. 5 and 7, the H.P. fluid after traversing the full length of the heat transfer core diverges from the L.P. fluid by turning inwards in the fluid transition zone 13, and exits the heat exchanger flowing radially inward, into the H.P. fluid exit manifold 25, whence it is discharged through the exit nozzle 26.

To provide structural integrity consistent with high differential pressure loadings, the plate webs and fins are thick in relation to the size of the passages, resulting in a heat exchanger core that is very rigid and, therefore, altogether immune to flow induced excitations. Tapered plate construction together with the resulting annular configuration assure that all the plate interactions are normal to the planes of contact and produce only low, outwardly radial load components on the plate. Consequently, reactions to be provided by enclosures 15 and 16 are relatively small, and the required thicknesses of said enclosures are only fractions of the shell thickness in a shell-and-tube type heat exchanger designed for comparable duty.

Figure 8:
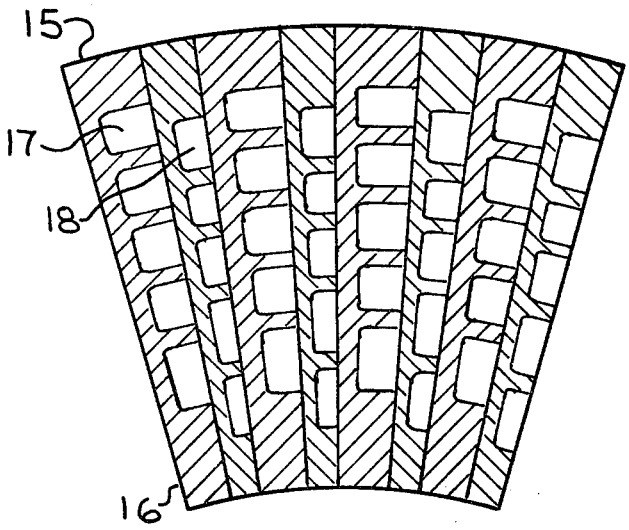
FIG. 8 is a cross-sectional view of the heat transfer core of the preferred embodiment with a modified, staggered pattern of fluid passages.

A modification of the preferred embodiment is presented in FIG. 8, with the parts which correspond to those shown in FIG. 6 being identified by the same numerals. In this modification the L.P. plate grooves 5 are displaced with respect to H.P. plate grooves 6 by one-half of a pitch, which results in a staggered pattern of fluid passages, with L.P. fluid passages 17 and H.P. fluid passages 18 lying along their own, separate circles. All plate fins now coincide with midspans of the neighboring plate webs, which serves to reduce the maximum bending moments in the plates.

Figure 9:
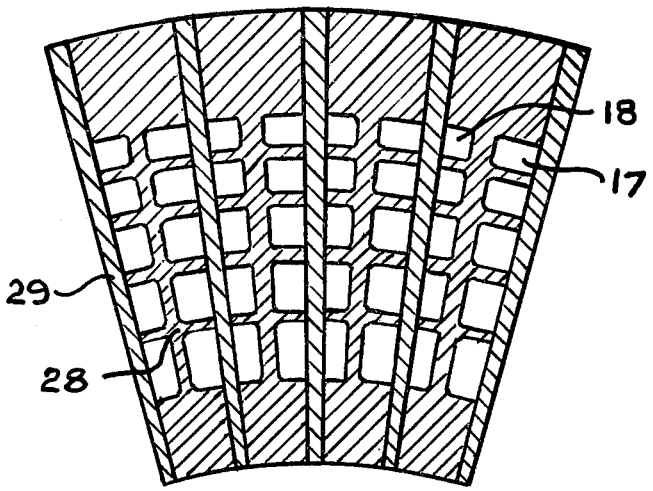
FIG. 9 is a cross-sectional view of the heat transfer core of an alternate embodiment of the invention.
Figure 10:
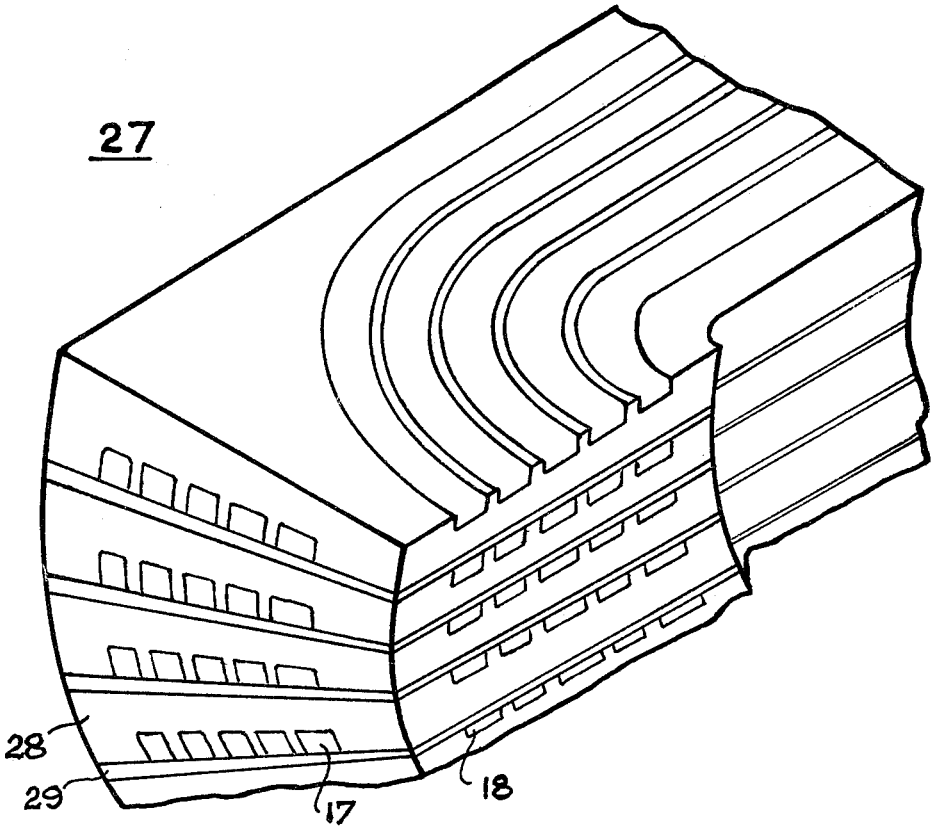
FIG. 10 is a perspective view on a segment of a fluid transition zone of the alternate embodiment of the invention, also shown in FIG. 9.

An alternate embodiment 27 of the present invention is shown in FIGS. 9 and 10, in combination. The heat exchanger still comprises two types of plates only. One, identified with numeral 28, is a tapered plate provided on one side with the same kind of grooves and land areas as the L.P. plate 1 of the preferred embodiment, shown on FIGS. 1 and 2; on the other side plate 28 is provided with the same kind grooves and land areas as the H.P. plate 2 of the preferred embodiment, shown on FIGS. 3 and 4. The other type of plate, 29, is just a plain tapered plate with no grooves at all. Plate assembly and joining is performed as in the preferred embodiment, plate 28 alternating with plate 29 and separating the H.P. side of any given one plate 28 from the L.P. side of the next plate 28. In the cross-section of the heat transfer core thus formed the L.P. fluid passages 17 and H.P. fluid passages 18 form an "in line" pattern, similar to that of FIG. 6, and shown in FIG. 9. This embodiment offers an alternate way of achieving essentially the same objectives as in the preferred embodiment shown on FIGS. 1 to 7.

Figure 11:
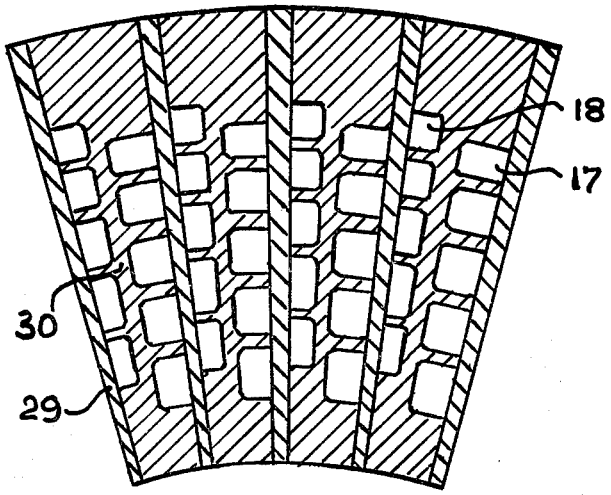
FIG. 11 is a cross-sectional view of the heat transfer core of the alternate embodiment of the invention with a modified, staggered pattern of fluid passages.

FIG. 11 shows a modification of an alternate embodiment 27 of FIGS. 8 and 9. This modification is analogous to modification, shown on FIG. 8, of the preferred embodiment 11 of FIGS. 1 to 7. The new grooved plate 30 differs from the plate 28 in that its L.P. type grooves and H.P. type grooves are displaced with respect to each other by one-half of a groove pitch. The result is a staggered pattern of the core cross-section and a reduction in plate bending moments.

While the above description refers explicitly to a counterflow heat exchanger in the form of a recuperator for a closed cycle power plant, and contains specificities, these should not be construed as limitations on the scope of the invention. As noted earlier, they facilitate setting forth the basic aspects of the invention in concrete terms. However, many other variations and modifications are possible and may even be desirable, all within the scope of the present invention. For example, both embodiments described in the foregoing are single pass heat exchangers with an equal number of L.P. and H.P. passages, whereas in some other applications it may be advantageous to provide different number of passages for each fluid there is no fundamental objection to provision of a different number of grooves in each plate in general. In still another application three or more different fluids may be involved in which case provision of additional plates with groove paths designed to form adequate entry and exit fluid transition zones, as formerly explained and additional manifold, would be required.

To conclude, the scope of the invention should be determined not by the embodiments illustrated, but by the attached claims.

I claim:

1. A heavy duty annular heat exchanger with multiplicity of parallel, essentially axial fluid passageways of small cross-section for heat transfer between a plurality of fluids in a high pressure environment, comprising:

a multiplicity of solid plates, in plurality of distinct sets, each said plate having a tapered cross-section taken in a plane perpendicular to the longitudinal axis of the heat exchanger, said plates being selectively provided with a multiplicity of essentially parallel, longitudinally disposed grooves of relatively small cross-section for defining fluid passages, wherein grooves adjacent plate edges define therewith land areas serving as primary plate joining surfaces and interior grooves define therebetween heat transfer fins which also serve as load carrying members;

said plates being juxtaposed and joined together to form a self-enclosed structure of annular, radially symmetric cross-section, defining a heat transfer core and fluid transition zones with a multiplicity of distinct fluid flow passageways; and means for introduction and discharge of a plurality of distinct fluids to and from their respective passageways.

2. A counterflow heat exchanger for two fluids, according to claim 1, wherein all said tapered plates are grooved on one side only and constitute two distinct sets, one with grooves running lengthwise throughout the whole plate length, the other with grooves lengthwise over the plate midsection but turning sideways at both plate ends, all said plates forming, upon being juxtaposed in pairs of different plates, back to face defining a heat transfer core and two fluid transition zones.

3. A counterflow heat exchanger for two fluids according to claim 1, wherein one set of said tapered plates is grooved on both sides, said grooves running lengthwise over the full plate length on one side of said plate, but turning sideways at both plate ends on the other side, another set of tapered plates being ungrooved, the plates of the two sets forming, upon being juxtaposed alternately in pairs defining a heat transfer core and two fluid transition zones.

4. A heat exchanger according to claim 2, wherein said grooves in the neighboring plates are staggered with relation to each other, thereby reducing bending stresses in the plates.

5. A heat exchanger according to claim 3, wherein said grooves on one side of said tapered plates grooved on both sides are staggered with the grooves on the other side, thereby reducing bending stresses in the plates.

6. A heat exchanger according to claim 1, wherein said tapered plates, all grooved on one side only, constitute three distinct sets, one with grooves running lengthwise throughout the whole plate length, two other sets with grooves turning sideways at both ends and in the opposite direction in each of said two sets, all said tapered plates thereby forming, upon being juxtaposed alternately back to face, passageways for three distinct fluids in the heat transfer core and in the fluid transition zones.

* * * * *